US008550239B2

(12) United States Patent
Nakonechny

(10) Patent No.: US 8,550,239 B2
(45) Date of Patent: Oct. 8, 2013

(54) INTERFACE APPARATUS FOR STACKING COIN HOLDERS

(76) Inventor: Stephen Nakonechny, Ocala, FL (US)

( * ) Notice: Subject to any disclaimer, the term of this patent is extended or adjusted under 35 U.S.C. 154(b) by 0 days.

(21) Appl. No.: 13/356,638

(22) Filed: Jan. 23, 2012

(65) Prior Publication Data

US 2012/0189384 A1 Jul. 26, 2012

Related U.S. Application Data

(60) Provisional application No. 61/435,131, filed on Jan. 21, 2011.

(51) Int. Cl.
*A45C 1/00* (2006.01)

(52) U.S. Cl.
USPC ..... 206/8; 206/0.81; 206/0.82; 206/0.84

(58) Field of Classification Search
USPC ..... 206/0.8–0.84
See application file for complete search history.

(56) References Cited

U.S. PATENT DOCUMENTS

| | | | | |
|---|---|---|---|---|
| 3,199,666 | A * | 8/1965 | Burdick | 206/0.82 |
| 4,915,214 | A * | 4/1990 | Wieder | 206/0.82 |
| 5,042,650 | A * | 8/1991 | Mayer et al. | 206/0.84 |
| 5,109,977 | A * | 5/1992 | Mayer et al. | 206/0.8 |
| 5,150,792 | A * | 9/1992 | Munroe | 206/486 |
| 6,029,807 | A * | 2/2000 | Love | 206/0.82 |
| 8,069,978 | B2 * | 12/2011 | Haire et al. | 206/0.8 |
| 2008/0023343 | A1 * | 1/2008 | Macor | 206/81 |
| 2008/0023351 | A1 * | 1/2008 | Macor | 206/232 |
| 2008/0023371 | A1 * | 1/2008 | Macor | 206/775 |
| 2008/0149518 | A1 * | 6/2008 | Macor | 206/459.5 |
| 2008/0230402 | A1 * | 9/2008 | Macor | 206/81 |

* cited by examiner

*Primary Examiner* — Victor MacArthur
(74) *Attorney, Agent, or Firm* — Massinger Law Offices

(57) ABSTRACT

An interface apparatus for identical and non-compatible coin holders that enables them to be vertically stacked one atop another, with the interface therebetween, and oriented such that their certificates of authenticity face the same direction. The subject interface apparatus is comprised of a substantially rectangular planar plate having irregular contoured front and back surfaces designed for mating engagement with NGC and PCGS coin cases to facilitate stacking thereof. The apparatus optionally includes voids or "windows" sized, shaped and located to enable viewing of coins and certificates disposed within the cases when mounted thereon.

19 Claims, 7 Drawing Sheets

INTERFACE APPARATUS FOR STACKING COIN HOLDERS

RELATED APPLICATION

This application claims the benefit of U.S. Provisional Application No. 61/435,131 filed Jan. 21, 2012 and entitled, Interface Apparatus for Stacking of Non-Compatible Coin Holders.

FIELD OF THE INVENTION

The present invention relates generally to encapsulated coin cases, and more particularly to an interface apparatus that facilitates the vertical stacking of non-compatible coin cases.

BACKGROUND OF THE INVENTION

Coin collectors, coin dealers, and Auction Galleries commonly use some type of plastic holder (also known as a "case" or "holder") to mount, protect, and display their coins, medals, and other collectibles. These holders are typically comprised of two housings or "plate members" that mate and lock together with the numismatic item enclosed therebetween inside a chamber formed by the two housings. In some cases, the holder is made to be tamper-proof by the sealing together of the housings by ultrasonic or adhesive sealing processes. Such is often the case when coins are graded, certified and/or authenticated by appraisers. Grading is a way of determining the physical condition of a coin. Once the coin has been graded, the coin is encapsulated in a tamper-evident, sealed, high-security case as a method of reinforcing its grade and authenticity. In addition, the unique certification number permanently sealed inside each coin case may be utilized by the coin's owner as a reliable means of identification after the coin enters the marketplace.

Two of the most prominent coin certification services are Professional Coin Grading Service of Newport Beach, Calif. ("PCGS") and Numismatic Guaranty Corporation of Sarasota, Fla. ("NGC"). The number of coin holders used to encapsulate coins that have been graded and/or certified by these organizations is in the millions.

It is a common practice of coin collectors, dealers and auction galleries to stack PCGS coin holders on top of each other for grouping, display, storage and/or transport. The same practice is performed for NGC coin holders. While PCGS holders possess surface architecture that enables them to be vertically stacked, they are not compatible with NGC coin holders, and vice versa. Accordingly, owners of both types of holders are limited to creating PCGS stacks and NGC stacks, but not combinations of both types. In this regard, the two coin holder types are "non-compatible". This is a significant shortcoming of these products because it is of considerable advantage to the collector and dealer to group their coins by various attributes (i.e.: denomination, series, mint state, proof etc.) and not which grading service provided certification.

To achieve stackability of PCGS and NGC non-compatible coin holders, a coin collector can send the graded coin for "cross over service", which entails removing the coin from its original holder to another service compatible coin holder. This is an inconvenience that cost money, time and involves a risk of the coin being lost, stolen or damaged during handling. The coin may even be declined for crossover due to the varied opinion in grading standards. In this case the collector would be forced to sell the coin for another more compatible coin. Accordingly, there is a need in the art for a means for facilitating the stacking of non-compatible coin holders.

The following patents relating to the storage of coins and the like, are incorporated herein by reference:

| | | | |
|---|---|---|---|
| U.S. Pat. No. 7,134,546 | November 2006 | Seligman et al | Coin Holder and Display Device |
| U.S. Pat. No. 6,814,227 | November 2004 | Seligman et al | Coin Holder and Display Device |
| Des 423,757 | April 2000 | Briggs | Coin Case |
| U.S. Pat. No. 6,029,807 | February 2000 | Love | Security Case with Stress Contour . . . |
| U.S. Pat. No. 5,590,761 | January 1997 | Owen | Coin Display Holder |
| U.S. Pat. No. 5,109,977 | May 1992 | Mayer | Tamperproof Coin Case |
| U.S. Pat. No. 5,069,347 | December 1991 | Newman | Locking Coin Display Holder |
| U.S. Pat. No. 5,043,650 | August 1991 | Mayer | Tamperproof Coin Case |
| U.S. Pat. No. 5,011,005 | April 1991 | Boyd | Protective Coin Holder |
| U.S. Pat. No. 4,915,214 | April 1990 | Wieder | Holder for Numismatic Items |
| U.S. Pat. No. 4,592,465 | June 1986 | Stein | Coin Display Case |
| U.S. Pat. No. 4,402,399 | September 1983 | Friess | System and Storage of Coins . . . |
| U.S. Pat. No. 3,797,649 | March 1974 | Ringle | Coin Holding Device |
| U.S. Pat. No. 3,788,464 | January 1974 | Skinner | Holder for Disc Like Objects |
| U.S. Pat. No. 3,751,128 | August 1973 | Skinner | Display Case and Assembly . . . |
| U.S. Pat. No. 3,635,335 | January 1972 | Kramer | Numismatic Coin or Medal Display Case |

All patents, patent applications, provisional applications, and publications referred to or cited herein, or from which a claim for benefit of priority has been made, are incorporated herein by reference in their entirety to the extent they are not inconsistent with the explicit teachings of this specification.

SUMMARY OF THE INVENTION

The subject apparatus meets the need in the art by providing an interface apparatus for identical and non-compatible coin holders that enables them to be vertically stacked one atop another, with the interface apparatus therebetween, and oriented such that their certificates of authenticity face the same direction. Very generally, the subject interface apparatus is comprised of a substantially rectangular planar plate having irregular contoured front and back surfaces designed for mating engagement with NGC and PCGS cases to facilitate stacking thereof. The apparatus optionally includes voids or "windows" sized, shaped and located to enable viewing of coins and certificates disposed within the cases when mounted thereon. The apparatus may be produced in a variety of colors to facilitate organization of coins by type, quality, date, or any other characteristics and is preferably sized to be greater in width and/or length than both NGC and PCGS cases in order to facilitate visualization of the apparatus in a stack of coin cases and to facilitate grasping of the apparatus by its side edges.

There has thus been outlined, rather broadly, the more important components and features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is, therefore, a primary object of the subject invention to provide an interface apparatus for PCGS and NGC coin cases of the variety described herein to permit the secure stacking of one atop the other with the interface disposed therebetween.

It is also a primary object of the invention to provide an interface apparatus for PCGS and NGC coin cases of the variety described herein to permit the secure stacking of one atop the other with their certificates of authenticity facing the same direction with the interface disposed therebetween.

It is another primary object of the subject invention to provide a two-sided interface apparatus wherein each side is capable of mating engagement with only one side of a PCGS case and only one side of an NGC case to facilitate vertical stacking thereof such that their certificates of authenticity face the same direction.

It is also an object of the subject invention to provide an interface apparatus that, when mated with a PCGS case or NGC case, does not obscure visibility of the coin and/or certificate housed therein.

Another object of the subject invention is to provide an interface apparatus which is relatively simple in design and of unibody construction and therefore capable of rapid construction at relatively low costs.

These together with other objects of the invention, along with the various features of novelty which characterize the invention, are pointed out with particularity in the claims annexed to and forming a part of this disclosure. For a better understanding of the invention, its advantages and the specific objects attained by its uses, reference should be had to the accompanying drawings and descriptive matter in which there is illustrated a preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
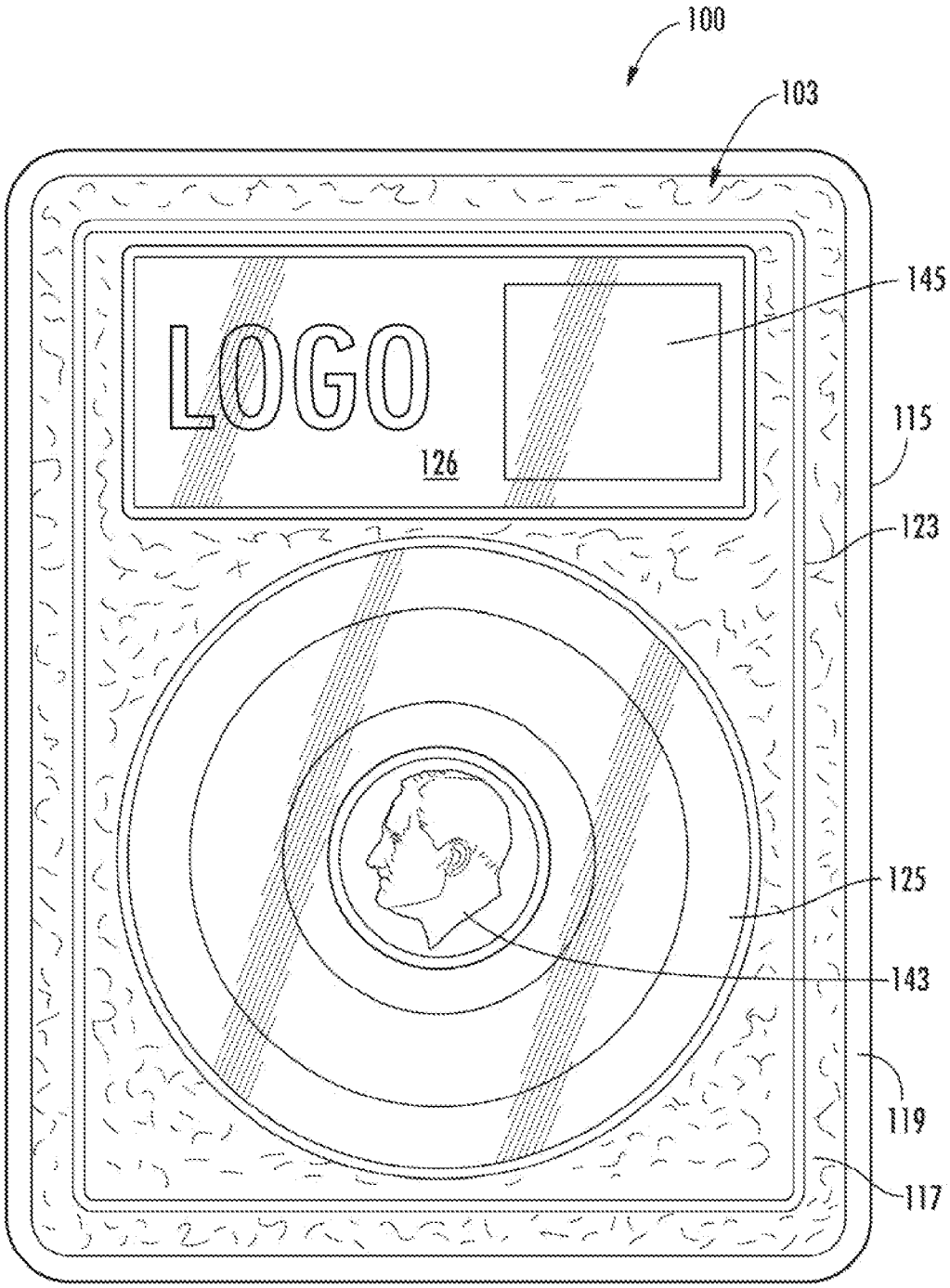
FIG. 1 PRIOR ART
FIG. 1 is a front elevation view of a PCGS tamperproof coin case.

It should be clearly understood at the outset that like reference numerals are intended to identify the same structural elements, portions or surfaces consistently throughout the several drawings herein, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, any reference to the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Before the subject invention and its advantages can be fully appreciated, it is first necessary to understand the construction of the two coin holder devices between which the subject apparatus is disposed to facilitate vertical stacking. The terms "case" and "holder" are used interchangeably herein and are considered synonymous.

Figure 2:
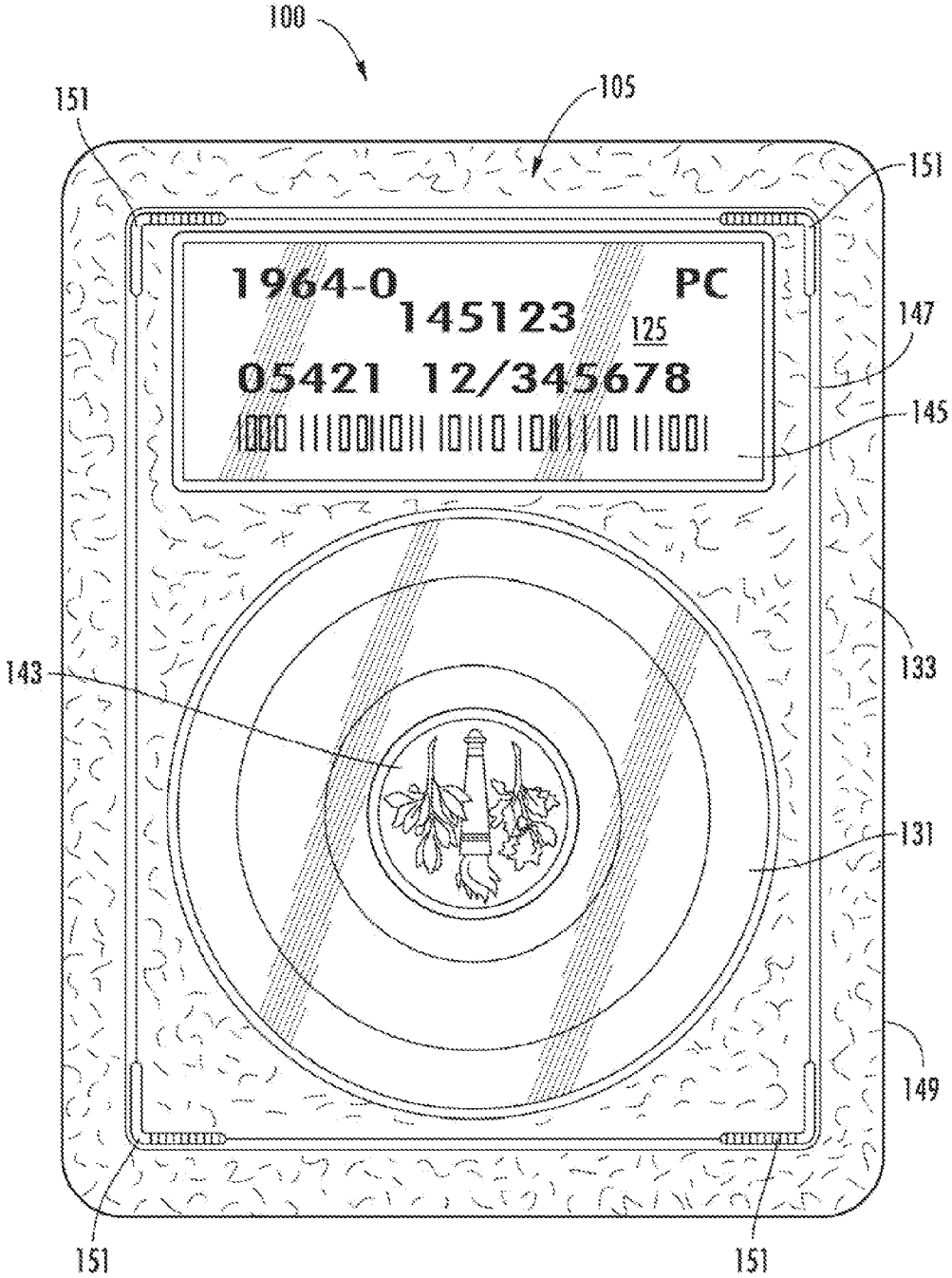
FIG. 2 PRIOR ART
FIG. 2 is a back elevation view of the PCGS coin case of FIG. 1.

Accordingly, reference is first made to FIGS. 1 and 2 in which there is illustrated front and back elevation views, respectively, of a PCGS case designated by reference numeral 100 (hereinafter also referred to as "PCGS case 100" and "case 100"). Case 100 is described in detail in U.S. Pat. Nos. 5,042,650 and 5,109,977 of Mayer et al. (assigned to PCGS) and is comprised in general of two interlocking plastic plate members 103,105 ultrasonically bonded together to define a unitary assembly having a front side 117 and a back side 133 the boundaries of each being defined by outer circumferential side walls 115 and 149, respectively, and between which a coin and its certificate of authenticity may be permanently secured. The surface architecture of front side 117 of case 100 is generally flat and includes a rectangular circumferential flange 123 projecting perpendicularly from its surface. Flange 123 is spaced inwardly from outer circumferential side wall 115. Front side 117 is also provided with a raised transparent window 125, preferably dome-shaped, the height of which should be the same as or less than the height of peripheral flange 123 relative the planar surface from which they project. A second transparent window 126, preferably of rectangular configuration, is also provided in member 103.

Similarly, plate member 105 includes a raised transparent dome-shaped window 131 projecting perpendicularly from the surface of back side 133 thereof. There is also provided a second transparent window 135 of rectangular configuration corresponding to second window 126 of plate member 103. When plate members 103 and 105 are assembled together, windows 125 and 131 are concentrically aligned and retain a desired coin 143 therebetween, and a certificate 145 may be disposed between plate members 103 and 105 in the vicinity of corresponding second windows 126 and 135 which are oriented one atop the other. Assembled case 100 clearly displays both obverse and reverse sides of coin 143 through opposed windows 125 and 131, respectively. Certificate 145 is visible from both sides of assembled case 100, but the important information for authenticating coin 143 in terms of identification and description of quality is typically visible only on back side 133 which is therefore alternately referred to herein as the "PCGS Certificate-Bearing-Side 133".

The surface architecture of back side 133 of case 100 is also generally flat and includes a rectangular circumferential flange 147 projecting perpendicularly from its surface. Flange 147 is also spaced inwardly from an outer circumferential side wall 149 of member 105 and corresponds substantially in configuration, location and size to flange 123. However, flange 147 also includes a right angle flange 151 positioned slightly inwardly of and extending outwardly (i.e., perpendicular to outer surface 133) from each corner portion thereof. Thus, when a plurality of assembled cases 100 are stacked same side up, right angle flanges 151 of flange 147 are interlocked against the inner surfaces of the corresponding corner portions of flange 123, thus providing vertical (i.e., stacked) alignment and preventing lateral movement (i.e., sliding along the plane of outer surfaces 117 and 133 relative to one another) of cases 100. A plurality of cases 100 may therefore be stacked together in "front-to-back-to-front . . . " fashion for transport or storage. To the extent it is not already apparent, as used herein, the term "front" refers to the outer facing surfaces of plate member 103 and the term "back" refers to the outer facing surfaces of plate member 105 when the two are assembled together.

Figure 3:
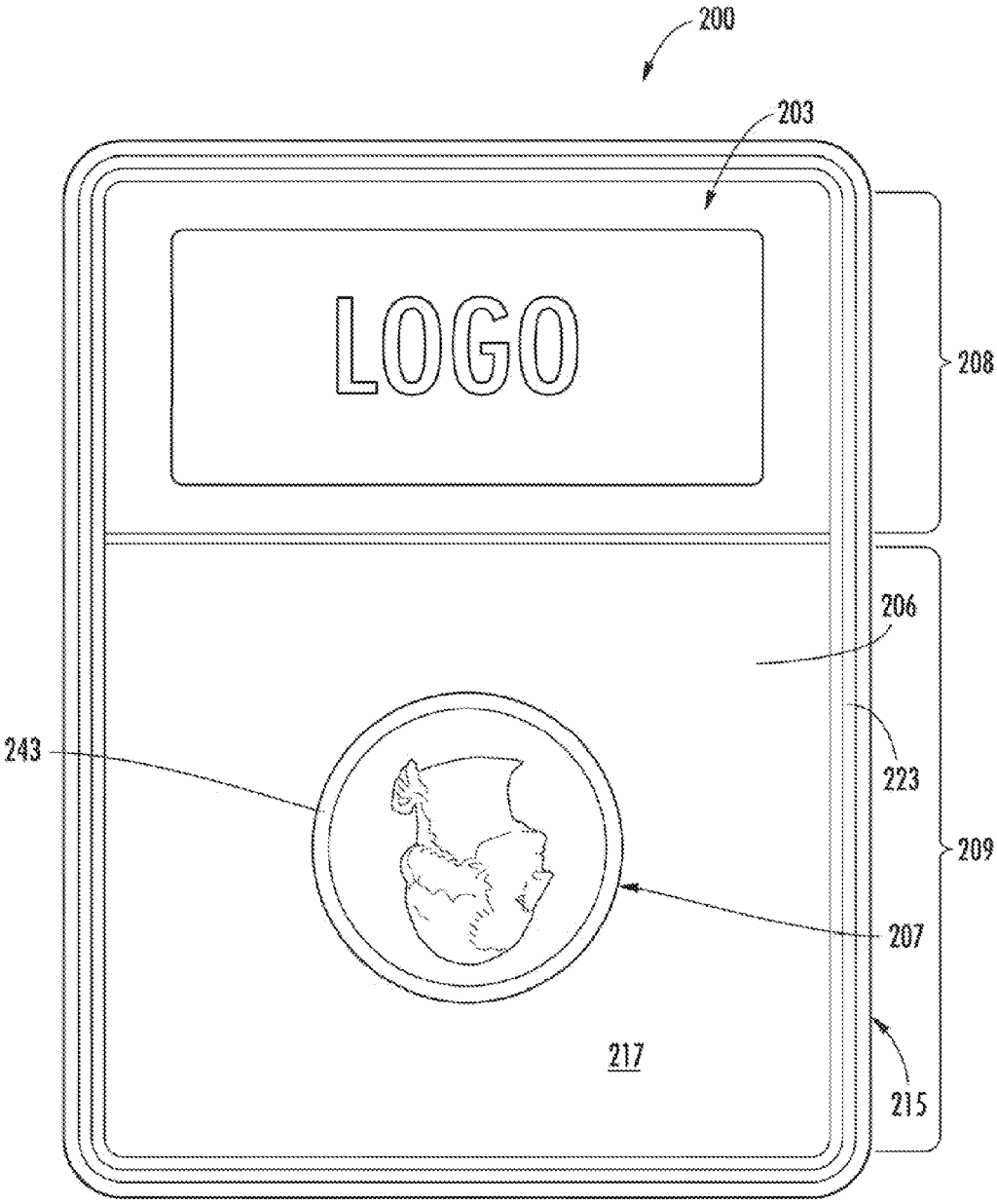
FIG. 3 PRIOR ART
FIG. 3 is a front elevation view of a NGC tamperproof coin case.
Figure 4:
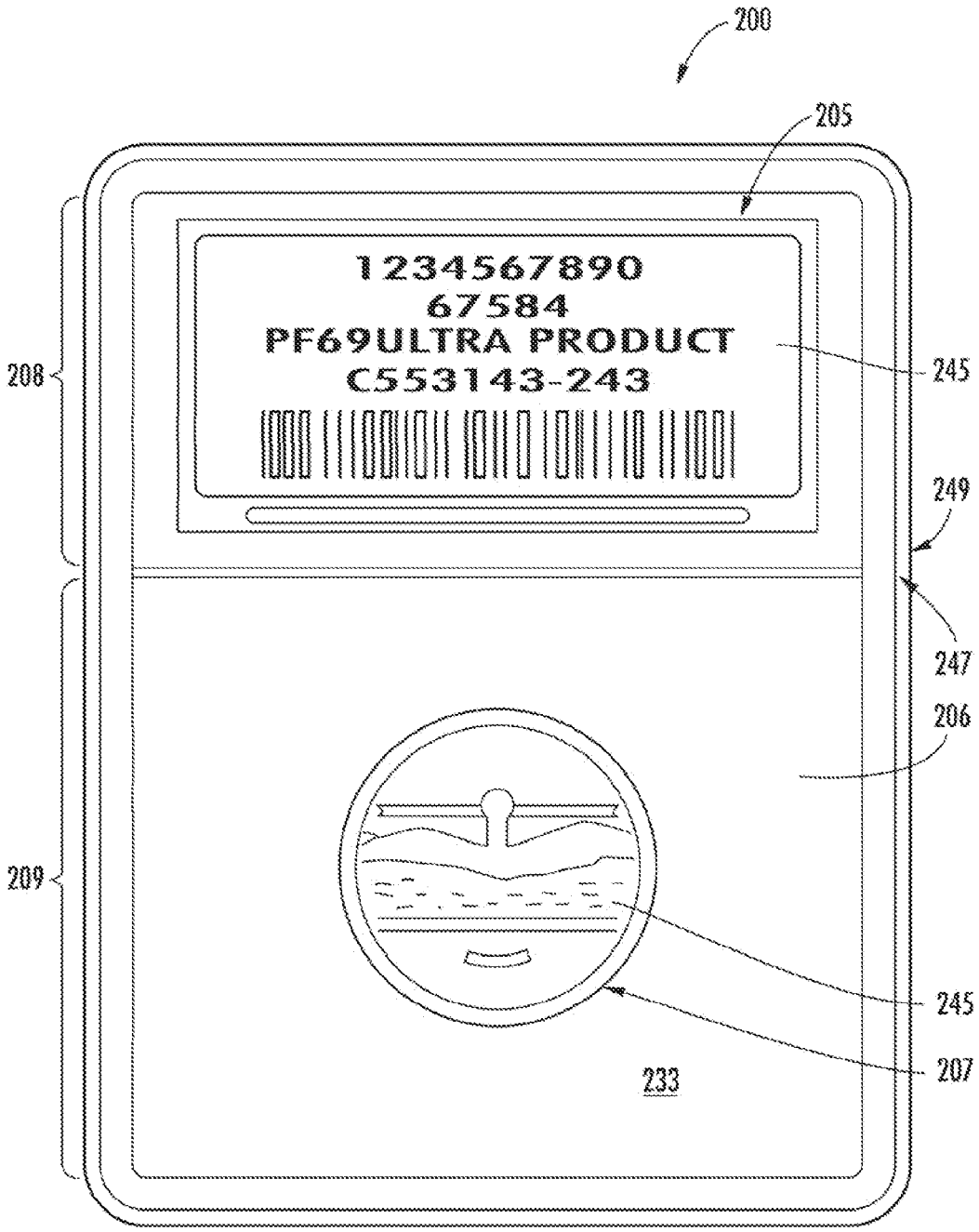
FIG. 4 PRIOR ART
FIG. 4 is a back elevation view of the NGC coin case of FIG. 3.

Reference is now made to FIGS. 3 and 4 in which there is illustrated front and back plan views, respectively, of an NGC case designated by reference numeral 200 (hereinafter also referred to as "NGC case 200" and "case 200"). Case 200 is generally comprised of two interlocking plastic plate members 203,205 ultrasonically bonded together to define a unitary assembly having a front side 217 and a back side 233 the boundaries of each being defined by outer circumferential side walls 115 and 149, respectively, and between which a coin 243 and its certificate of authenticity 245 may be permanently secured. More specifically, case 200 includes a first transparent plate member 203 and a corresponding second transparent plate member 205. When plate members 203 and 205 are assembled together, they house a generally rectangular opaque coin mounting panel 206 the front and back surfaces of which are visible through the transparent plate members. A desired coin 243 is mounted in an aperture 207 occupying a first portion 208 of mounting panel 206 and a certificate 245 may be disposed in the vicinity of a second portion 209 of mounting panel 206 and between plate members 103 and 105. Assembled case 200 clearly displays both obverse and reverse sides of coin 243 through transparent plate members 203 and 205, respectively. Certificate 245 serves to provide important information for authenticating coin 243 in terms of identification and description of quality, This information for is typically visible only on back side 233 which is therefore alternately referred to herein as the "NGC Certificate-Bearing-Side 233"

The surface architecture of front side 217 of case 200 is generally flat and includes a rectangular circumferential flange 223 projecting perpendicularly from its surface. Flange 223 is spaced inwardly from an outer circumferential side wall 215 of plate member 203. A second circumferential flange 247 extends perpendicular to the surface of back side 233 of plate member 205 and is an extension of outer circumferential side wall 249 of plate member 205. First flange 223 corresponds substantially in configuration to second flange 247 and is sized for mating engagement within the inner facing walls of second circumferential flange 247. Thus, when a plurality of assembled cases 200 are stacked vertically, the outer surfaces of first flange 223 abut against the inner surfaces of second flange 247 providing vertical alignment and preventing lateral movement of cases 200 relative to one another. A plurality of cases 200 may therefore be stacked together in "front-to-back-to-front . . . " fashion for transport or storage. As used herein, the term "front" refers to the outer facing surfaces of plate member 203 and the term "back" refers to the outer facing surfaces of plate member 205 when the two are assembled together.

As mentioned previously, while PCGS holders possess surface architecture that enables them to be stacked one atop another, they are not compatible (i.e., securely stackable) with NGC coin holders, and vice versa. More specifically, the PCGS Certificate-Bearing-Side of PCGS case 100 is not compatible (i.e., will not fit in secure mating engagement) with the NGC Certificate-Bearing-Side (or the opposite side for that matter) of an NGC case 200. Similarly, the NGC. Certificate-Bearing-Side of an NGC case 200 is not compatible with the PCGS Certificate-Bearing-Side (or the opposite side for that matter) of a PCGS case 100. It is desirable to many coin collectors that cases of both the PCGS and NGC variety described herein be stackable on atop the other, particularly with their Certificate-Bearing-Sides facing the same direction to facilitate rapid identification of the certification details. It is also desirable that coins of similar type, quality, year, etc. be organized in readily identifiable groups. The subject apparatus may be fabricated in a variety of colors to serve as "dividers" to aid in coin organization such as by separating PCGS and/or NGC coin cases housing coins of a particular type into stacks (or into a group within a stack) identifiable by a chosen color of dividers employed therein.

Figure 5:
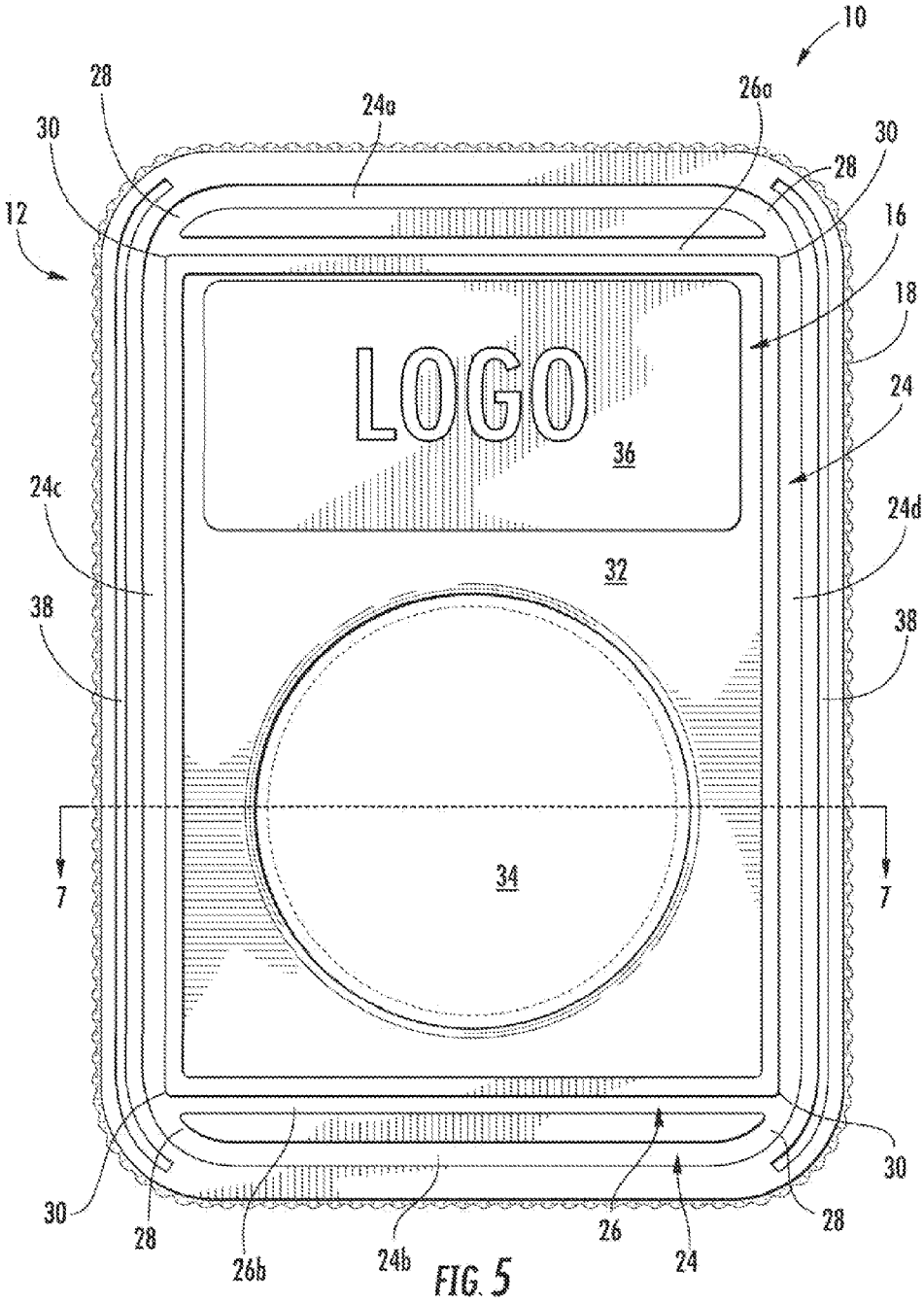
FIG. 5 is a front elevation view of an embodiment of the interface apparatus of the subject invention for stacking coin holders.
Figure 6:
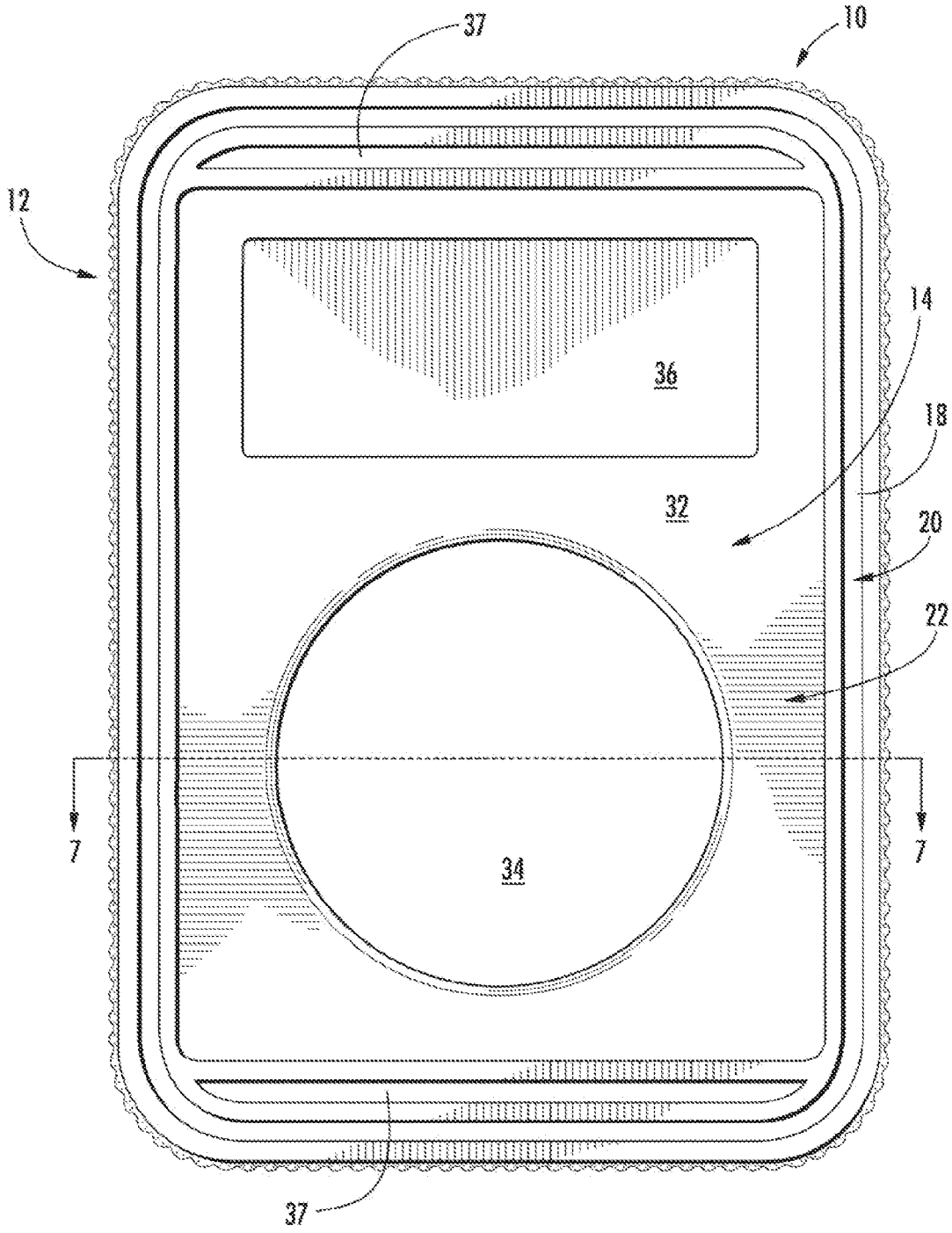
FIG. 6 is a back elevation view of the interface apparatus of FIG. 5.
Figure 7:
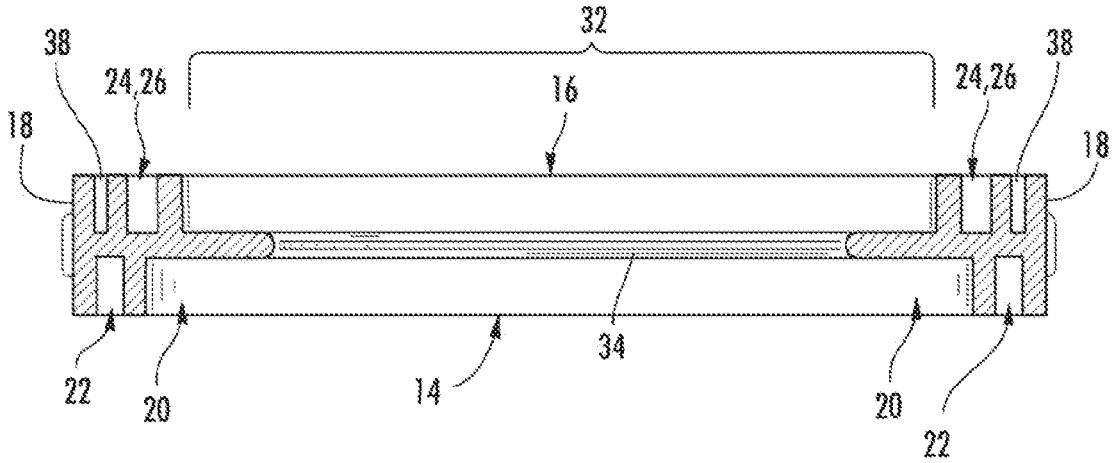
FIG. 7 is a cross-sectional view taken along lines 7-7 of the interface apparatus of FIGS. 5 and 6.

Reference is now made to FIGS. 5 and 6 in which there is illustrated front and back views, respectively, of an embodiment of the subject coin holder interface apparatus (hereinafter referred to as simply "interface apparatus"), designated generally by reference numeral 10. Interface apparatus 10 is comprised of a substantially rectangular planar plate 12 having a front side 16 (FIG. 5), a back side 14 (FIG. 6), and an outer circumferential side wall 18. Outer circumferential side wall 18 is preferably but not essentially knurled, reeded or otherwise textured to provide a surface that is more easily gripped by the user. Plate 12 is preferably but not essentially made of plastic such as by injection molding, but may also be made of metal, wood, or any other suitable material.

Referring first to FIG. 6, the surface architecture of back side 14 of the subject apparatus 10 is generally flat and includes a first circumferential channel 20 spaced inwardly from side wall 18 and sized and shaped for receiving therein in mating engagement circumferential flange 247 of NGC Certificate-Bearing-Side 233 of NGC case 200. Back side 14 of apparatus 10 further includes recessed area 22 located inwardly from first channel 20 and sized and shaped for receiving in mating engagement circumferential flange 147 and right angle flanges 151 of PCGS Certificate-Bearing-Side 133 of PCGS case 100.

Referring now to FIG. 5, the surface architecture of front side 16 of the subject apparatus 10 includes a first circumferential channel 24 spaced inwardly from side wall 18 and sized and shaped for receiving in mating engagement second circumferential flange 223 of front side 217 of NGC case 200. Front side 16 further includes a second circumferential channel 26 partially overlapping first channel 24 and sized and shaped for receiving in mating engagement circumferential flange 123 of front side 117 of PCGS case 100. More specifically, first circumferential channel 24 is comprised of top recess 24*a*, bottom recess 24*b* and a pair of opposing parallel side recesses 24*c,d*. Top recess 24*a* and bottom recess 24*b* are joined with perpendicularly oriented side recesses 24*c,d* via radial recesses (i.e. corners) 28. First circumferential channel 24 and second circumferential channel 26 share in common side recesses 24*c,d*. Transverse top recess 26*a* and transverse bottom recess 26*b*, both of second circumferential channel 24, are spaced inwardly of top recess 24*a* and bottom recess 24*b*, respectively, and are joined at their ends to the ends of side recesses 24*c,d* at substantially right angle corners 30 to complete second circumferential channel 26 of front side 16 of the subject apparatus 10.

Second circumferential channel 26 of front side 16 defines the boundaries of a solid area 32 which may optionally include at least one window alternately comprised of a void, or a transparent or translucent panel through which a portion of the underlying case 100,200 may be viewed. For example, circular window 34 in solid area 32 substantially corresponds in shape and location to the locations of coins 143,243 of cases 100,200, respectively, such that the coins are visible through opening 34 when the subject apparatus 10 is mated with case 100, case 200, or both. Solid area 32 may further or alternately include a second window such as rectangular window 36 for the viewing of certificates 145,245 therethrough when the subject apparatus 10 is mated with case 100, case 200, or both. Alternately, at least one window 34,36 may be comprised of an opaque panel for bearing indicia such as logos, contact information, or the like. In the embodiment illustrated in FIG. 5, window 36 is of the solid variety and raised a distance above solid area 32 to bear the product "logo".

Finally, it is advantageous that apparatus 10 be as lightweight as possible without sacrificing structural integrity. To that end, and by way of example only, back side 14 of apparatus 10 includes transverse grooves 37 and front side 16 includes longitudinal grooves 38 to lessen product weight through the elimination of the material that would otherwise occupy these recesses. Those skilled in the art will recognize additional and alternative means of reducing the weight of the subject apparatus.

As should now be obvious from the above description, the 3-dimensional surface architecture of back side 14 of apparatus 10 is specifically designed with first interface means to interface with both PCGS and NGC Certificate-Bearing-Sides 133,233 of PCGS case 100 and NGC case 200, respectively, and the 3-dimensional surface architecture of front side 16 of apparatus 10 is specifically designed with second interface means to interface with the opposite sides of both cases 100,200, namely front sides 117 and 217, respectively. Accordingly, apparatus 10 may be disposed between and in be in mating engagement with both a PCGS coin case 100 and an NGC coin case 200 with the Certificate-Bearing-Sides of each case 100,200 facing in the same direction.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed as being new, useful and desired to be protected by Letters Patent of the United States is as follows:

1. An adaptor for facilitating the stacking of PCGS and NGC coin holders each having a Certificate-Bearing-Side and a non-Certificate-Bearing-Side, the adaptor comprising: a substantially rectangular planar plate having a front side, a back side, and an outer circumferential side wall; said back side having first circumferential channel spaced inwardly from said outer circumferential side wall for mating engagement with the Certificate-Bearing-Side of an NGC coin holder, and a recessed area located inwardly from said first circumferential channel and sized and shaped for mating engagement the Certificate-Bearing-Side of a PCGS coin holder; said front side having second circumferential channel spaced inwardly from said outer circumferential side wall for mating engagement with the non-Certificate-Bearing-Side of an NGC coin holder, and a third circumferential channel partially overlapping said second circumferential channel and sized and shaped for mating engagement with the non-Certificate-Bearing-Side of a PCGS coin holder; whereby said adaptor may be disposed between and in mating engagement with normally incompatible PCGS and NGC coin cases to permit the stacking thereof one atop the other and further may be disposed between and in mating engagement with two PCGS coin cases or two NGC coin cases.

2. The adaptor of claim 1 wherein said second circumferential channel is comprised of a top recess, a bottom recess parallel to said top recess, a first side recess, and a second side recess parallel to said first side recess, said top recess and said bottom recess being perpendicular to said side recesses.

3. The adaptor of claim 2 wherein said top recess and said bottom recess are each joined with said first side recess and said second side recess via a radial recess.

4. The adaptor of claim 3 wherein said second circumferential channel and third circumferential channel share in common said first side recess and said second side recess.

5. The adaptor of claim 4 wherein said third circumferential channel is further comprised of transverse top recess and parallel transverse bottom recess spaced inwardly of said top recess and said bottom recess, respectively.

6. The adaptor of claim 3 wherein said third circumferential channel is further comprised of transverse top recess and parallel transverse bottom recess spaced inwardly of said top recess and said bottom recess, respectively.

7. The adaptor of claim 3 wherein said third circumferential channel defines the boundaries of a solid area optionally including at least one window selected from a group consisting of a void, a transparent panel and a translucent panel.

8. The adaptor of claim 7 wherein said at least one window is positioned to alternately permit a coin or certificate mounted to a PCGS coin holder or a NGC coin holder to be viewed through said window when at least one of the PCGS coin holder and the NGC coin holder are stacked in mating engagement with said adaptor.

9. The adaptor of claim 2 wherein said second circumferential channel and third circumferential channel share in common said first side recess and said second side recess.

10. The adaptor of claim 9 wherein said third circumferential channel is further comprised of transverse top recess and parallel transverse bottom recess spaced inwardly of said top recess and said bottom recess, respectively.

11. The adaptor of claim 9 wherein said third circumferential channel defines the boundaries of a solid area optionally including at least one window selected from a group consisting of a void, a transparent panel and a translucent panel.

12. The adaptor of claim 11 wherein said at least one window is positioned to alternately permit a coin or certificate mounted to a PCGS coin holder or a NGC coin holder to be viewed through said window when at least one of the PCGS coin holder and the NGC coin holder are stacked in mating engagement with said adaptor.

13. The adaptor of claim 2 wherein said third circumferential channel is further comprised of transverse top recess and parallel transverse bottom recess spaced inwardly of said top recess and said bottom recess, respectively.

14. The adaptor of claim 2 wherein said third circumferential channel defines the boundaries of a solid area optionally including at least one window selected from a group consisting of a void, a transparent panel and a translucent panel.

15. The equine adaptor of claim 14 wherein said at least one window is positioned to alternately permit a coin or certificate mounted to a PCGS coin holder or a NGC coin holder to be viewed through said window when at least one of the PCGS coin holder and the NGC coin holder are stacked in mating engagement with said adaptor.

16. The adaptor of claim 1 wherein said third circumferential channel defines the boundaries of a solid area optionally including at least one window selected from a group consisting of a void, a transparent panel and a translucent panel.

17. The adaptor of claim 16 wherein said at least one window is positioned to alternately permit a coin or certificate mounted to a PCGS coin holder or a NGC coin holder to be viewed through said window when at least one of the PCGS coin holder and the NGC coin holder are stacked in mating engagement with said adaptor.

18. The adaptor of claim 1 wherein said third circumferential channel defines the boundaries of a solid area optionally including at least one window selected from a group consisting of a void, a transparent panel and a translucent panel.

19. The adaptor of claim 18 wherein said at least one window is positioned to alternately permit a coin or certificate mounted to a PCGS coin holder or a NGC coin holder to be viewed through said window when at least one of the PCGS coin holder and the NGC coin holder are stacked in mating engagement with said adaptor.

* * * * *